US009631449B1

(12) United States Patent
Hosie

(10) Patent No.: US 9,631,449 B1
(45) **Date of Patent: *Apr. 25, 2017**

(54) SUBSEA TEST ADAPTOR FOR CALIBRATION OF SUBSEA MULTI-PHASE FLOW METER DURING INITIAL WELL CLEAN-UP AND TEST AND METHODS OF USING SAME

(71) Applicant: Stanley Hosie, Katy, TX (US)

(72) Inventor: Stanley Hosie, Katy, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/090,999

(22) Filed: Apr. 5, 2016

Related U.S. Application Data

(63) Continuation of application No. 14/216,770, filed on Mar. 17, 2014.

(60) Provisional application No. 61/786,767, filed on Mar. 15, 2013.

(51) Int. Cl.

| | |
|---|---|
| ***E21B 33/035*** | (2006.01) |
| ***E21B 29/12*** | (2006.01) |
| ***E21B 19/00*** | (2006.01) |
| ***E21B 33/038*** | (2006.01) |
| ***E21B 34/04*** | (2006.01) |
| ***E21B 47/10*** | (2012.01) |
| ***E21B 47/00*** | (2012.01) |
| ***E21B 17/01*** | (2006.01) |

(52) U.S. Cl.
CPC ..... *E21B 33/038* (2013.01); *E21B 17/01* (2013.01); *E21B 34/04* (2013.01); *E21B 47/0001* (2013.01); *E21B 47/10* (2013.01)

(58) Field of Classification Search
None
See application file for complete search history.

(56) References Cited

U.S. PATENT DOCUMENTS 6,823,941 B2 * 11/2004 Donald ..... E21B 33/035 166/368
7,201,229 B2 * 4/2007 White ..... E21B 43/01 166/344
7,921,917 B2 * 4/2011 Kotrla ..... E21B 33/035 166/339

(Continued)

OTHER PUBLICATIONS

Patent Cooperation Treaty; PCT International Search Report, Issued for PCT/US2014/030669; Dec. 2, 2015; 3 pages; Europe.

(Continued)

*Primary Examiner* — Matthew R Buck
*Assistant Examiner* — Douglas S Wood
(74) *Attorney, Agent, or Firm* — Greenberg Traurig LLP

(57) ABSTRACT

Adapters for inclusion on the lower end of a completion/work-over riser includes a flow loop in fluid communication with a production flow loop hub and a production bore to facilitate testing and calibration of a subsea multi-phase flow meter during completion operations. The flow loop can be in fluid communication with one or more flow loop isolation valves, one or more production bore isolation valves, one or more annulus bore isolation valves, or one or more cross-over valves. In addition, a pressure/temperature sensor can also be included in the adapter. The adapters disclosed herein permit production fluid to flow through the subsea multi-phase flow meter while the riser is still attached to the subsea Christmas tree and before production operations have begun.

11 Claims, 4 Drawing Sheets

(56) References Cited

U.S. PATENT DOCUMENTS

| | | | | |
|---|---|---|---|---|
| 8,220,535 | B2 * | 7/2012 | Donald | E21B 33/03 166/75.12 |
| 8,297,359 | B2 * | 10/2012 | McKay | E21B 33/035 166/339 |
| 2002/0070026 | A1 | 6/2002 | Fenton et al. | |
| 2007/0144743 | A1 | 6/2007 | White et al. | |
| 2008/0257032 | A1 | 10/2008 | Zollo et al. | |
| 2014/0262306 | A1 * | 9/2014 | Hosie | E21B 33/038 166/336 |

OTHER PUBLICATIONS

Patent Cooperation Treaty; PCT Written Opinion of the International Searching Authority, Issued for PCT/US2014/030669; Dec. 2, 2015; 8 pages; Europe.

* cited by examiner

SUBSEA TEST ADAPTOR FOR CALIBRATION OF SUBSEA MULTI-PHASE FLOW METER DURING INITIAL WELL CLEAN-UP AND TEST AND METHODS OF USING SAME

RELATED APPLICATION

This application is a continuation of, and claims the benefit and priority benefit of, U.S. patent application Ser. No. 14/216,770, filed Mar. 17, 2014, entitled "Subsea Test Adaptor for Calibration of Subsea Multi-Phase Flow Meter During Initial Well Clean-Up and Test and Methods of Using Same".

BACKGROUND

1. Field of the Disclosure

The disclosure is directed to devices and methods for testing and calibrating a subsea multi-phase flow meter during initial well clean-up and test and, in particular, to an adaptor disposed between the subsea Christmas tree and lower riser package to circulate fluid flowing from the subsea Christmas tree, through the subsea multi-phase flow meter, and back into the production bore of the completion/work-over riser.

2. Description of the Related Art

Completion/work-over risers are known in the art. In general, such risers include an emergency disconnect package and a lower riser package and is connected to a surface Christmas tree located on a drilling platform or vessel in offshore completion operations. The surface Christmas tree is in fluid communication with a production bore and an annulus bore which are also in fluid communication with, through the emergency disconnect package and the lower riser package, a subsea Christmas tree connected to a wellhead disposed on the surface of the ocean. Both the production bore and the annulus bore pass through the emergency disconnect package, the lower riser package, and the subsea Christmas tree, each of which includes one or more valves that can be actuated valves or remote operated valves (ROVs).

Connected to the subsea Christmas tree at or near the surface of the ocean, and in fluid communication with at least the production bore passing through the subsea Christmas tree, is a subsea multi-phase flow meter. The subsea multi-phase flow meter is in fluid communication with a production control valve, or choke, which is in fluid communication with a production flow loop hub. During completion, the production flow loop hub is closed off. When the well is ready for production, a flow line is attached to the production flow loop hub to carry fluids from the wellhead through the subsea Christmas tree to a production platform, pipeline, production vessel, and the like.

Before production begins, the wellbore is "cleaned-up" by flowing fluid from the wellbore to which the wellhead is connected, up through the production bore to the drilling platform where it passes through a surface test unit for flow calibration. In flowing up the production bore, the fluid travels a great distance during which the temperature and pressure of the fluid changes. Accordingly, the composition of the fluid changes as a result of these changes in temperature and pressure. Therefore, the testing at the surface is on a different composition of fluid as compared to the fluid flowing through the subsea multi-phase flow meter during production operations. In addition, during this traditional clean-up operation, no fluid flows through the subsea multi-phase flow meter and, therefore, the subsea multi-phase flow meter is not tested for operational integrity, nor is it calibrated before production operations begin.

BRIEF SUMMARY

The following presents a simplified summary of the disclosed subject matter in order to provide a basic understanding of some aspects of the subject matter disclosed herein. This summary is not an exhaustive overview of the technology disclosed herein. It is not intended to identify key or critical elements of the invention or to delineate the scope of the invention. Its sole purpose is to present some concepts in a simplified form as a prelude to the more detailed description that is discussed later.

Broadly, the devices disclosed herein are directed to adaptors for flowing fluid through the subsea multi-phase flow meter and back into the production bore of a riser during well clean-up and testing. In one particular embodiment, the adapter includes a flow loop in fluid communication with the production flow loop hub and the production bore. In another specific embodiment, the flow loop includes an isolation valve. In still other embodiments, the adapter includes one or more production isolation valves in fluid communication the production bore of the completion riser. In yet other embodiments, the adapter includes one or more annulus isolation valves in fluid communication with the annulus bore. In other particular embodiments, the adapter includes one or more cross-over valves in fluid communication with the production bore and the annulus bore. In another specific embodiment, the adapter includes a pressure and temperature sensor in fluid communication with the production bore.

BRIEF DESCRIPTION OF THE DRAWING

The present adaptor and method of using it may be understood by reference to the following description taken in conjunction with the accompanying drawing, in which.

Figure 2:
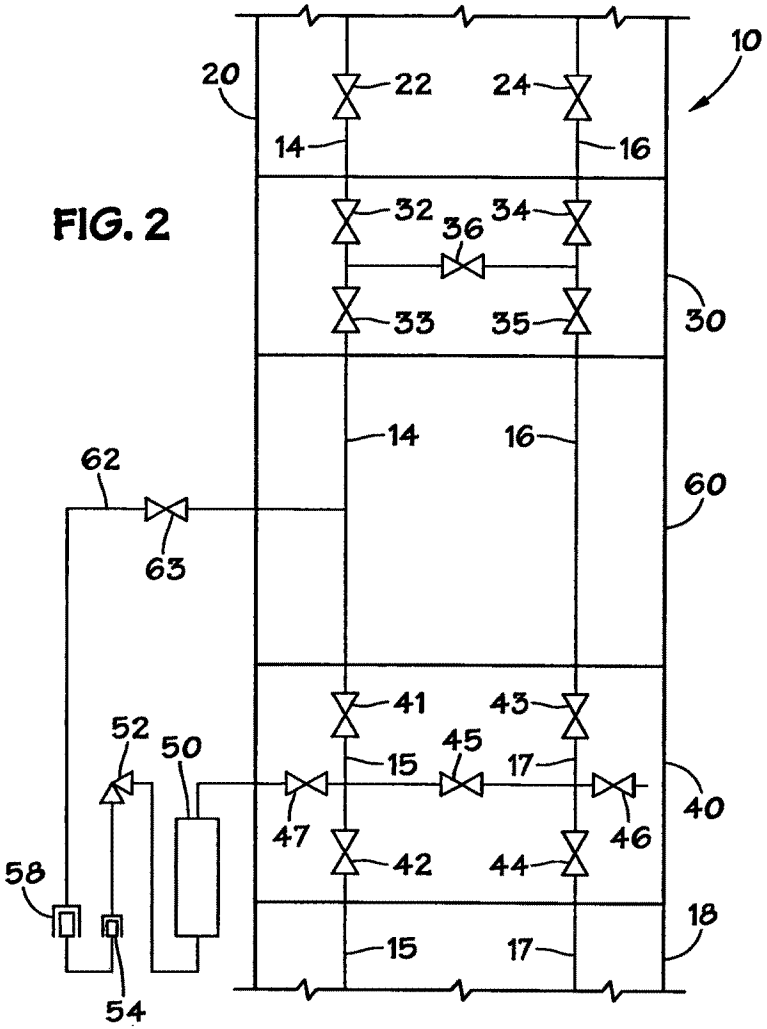
FIG. 2 is a schematic of another specific embodiment of an adapter disclosed herein disposed in a completion/work-over riser.

While certain embodiments of the present adapter and method of using it will be described in connection with the preferred illustrative embodiments shown herein, it will be understood that it is not intended to limit the invention to those embodiments. On the contrary, it is intended to cover all alternatives, modifications, and equivalents, as may be included within the spirit and scope of the invention as defined by the appended claims. In the drawing figures, which are not to scale, the same reference numerals are used throughout the description and in the drawing figures for components and elements having the same structure, and primed reference numerals are used for components and elements having a similar function and construction to those components and elements having the same unprimed reference numerals.

DETAILED DESCRIPTION OF INVENTION

Referring now to FIGS. 1-4, completion/work-over riser 10 comprises production bore 14 and annulus bore 16. Riser 10 is attached at a lower end to subsea Christmas tree 40, which is attached to wellhead 18, and at an upper end to a surface Christmas tree (not shown) located on a surface platform or vessel (not shown). All of these connections are made using devices and methods known in the art.

Riser 10 includes emergency disconnect package 20 and lower riser package 30. Each of these components is known in the art and is secured to each other through devices and methods known in the art. Generally, production bore 14 and annulus bore 16 pass through each of these components and are in fluid communication with production bore 15 and annulus bore 17 of subsea Christmas tree 40 and wellhead 18. In addition, each of these components includes one or more valves. For example, as shown in FIGS. 1-4, emergency disconnect package 20 includes production bore isolation valve 22 and annulus bore isolation valve 24; and lower riser package 30 includes first and second production bore isolation valves or rams 32, 33, first and second annulus bore isolation valves or rams 34, 35, and cross-over valve 36 disposed between first and second production bore isolation valves 32, 33 and between first and second annulus bore isolation valves 34, 35. Each of the foregoing valves in each of these components is known in the art.

Subsea Christmas tree 40 also includes various valves including production bore swab valve 41, production bore master valve 42, annulus bore swab valve 43, annulus bore master valve 44, cross-over valve 45 disposed between production bore swab valve 41 and production bore master valve 42 and between annulus bore swab valve 43 and annulus bore master valve 44, annulus wing valve 46, and production wing valve 47. Each of the foregoing valves is known in the art.

Subsea multi-phase flow meter 50 is in fluid communication with production wing valve 47 of subsea Christmas tree 40. Production control valve, or choke, 52 is in fluid communication with multi-phase flow meter 50 and disposed downstream of multi-phase flow meter 50. Downstream and in fluid communication with production control valve 52 is flowline connector/hub 54 and downstream and in fluid communication with flowline connector/hub 54 is production flow loop hub 58. During production, production flow loop hub 58 is in fluid communication (fluid line not shown) with a production platform, production vessel, pipeline and the like (not shown) to transport fluid flowing from the wellbore through wellhead 18, through production bore 15 of subsea Christmas tree, through production wing valve 47, through multi-phase flow meter 50, through production control valve 52, through flowline connector/hub 54, and through production flow loop hub 58.

As illustrated in each of the embodiments of FIGS. 1-4, adapter 60 is included as part of riser 10 by being disposed between lower riser package 30 and subsea Christmas tree 40. Production bore 14 and annulus bore 16 are disposed through adapter 60 so that both production bore 14 and annulus bore 16 pass through the entirety of riser 10 and so that production bore 14 is in fluid communication with production bore 15, and annulus bore 16 is in fluid communication with annulus bore 17. Adapter 60 includes flow loop 62 in fluid communication with production bore 14 and production flow loop hub 58. Flow loop 62 can be a rigid or flexible conduit.

Figure 1:
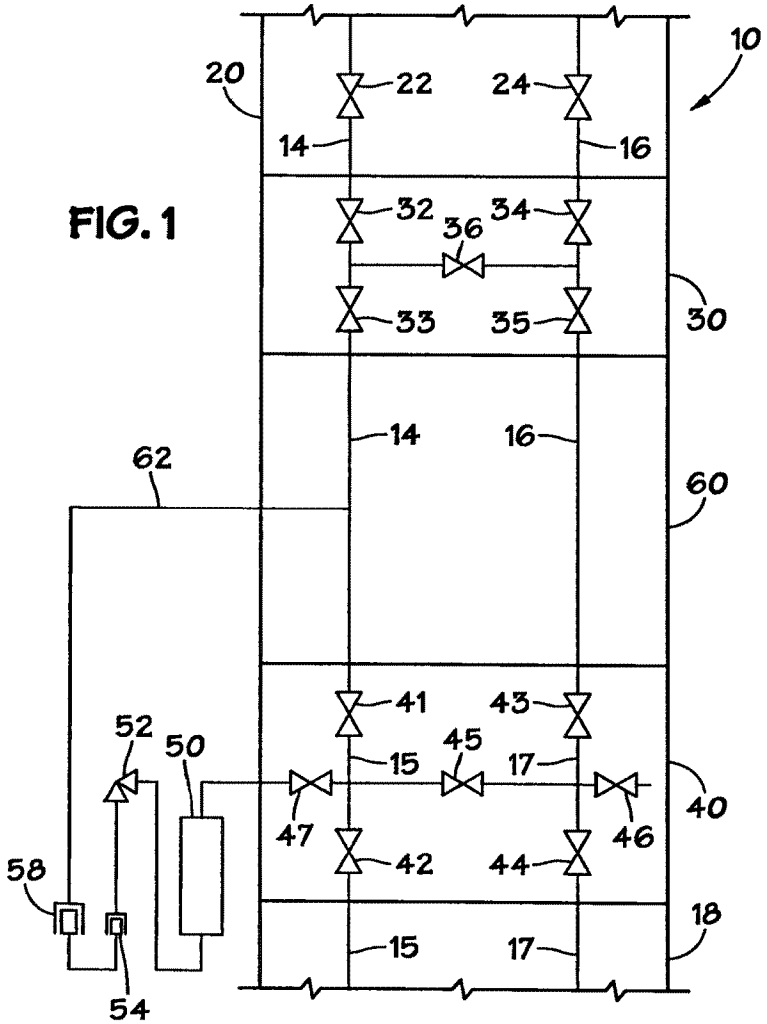
FIG. 1 is a schematic of one specific embodiment of an adapter disclosed herein disposed in a completion/work-over riser.
Figure 4:
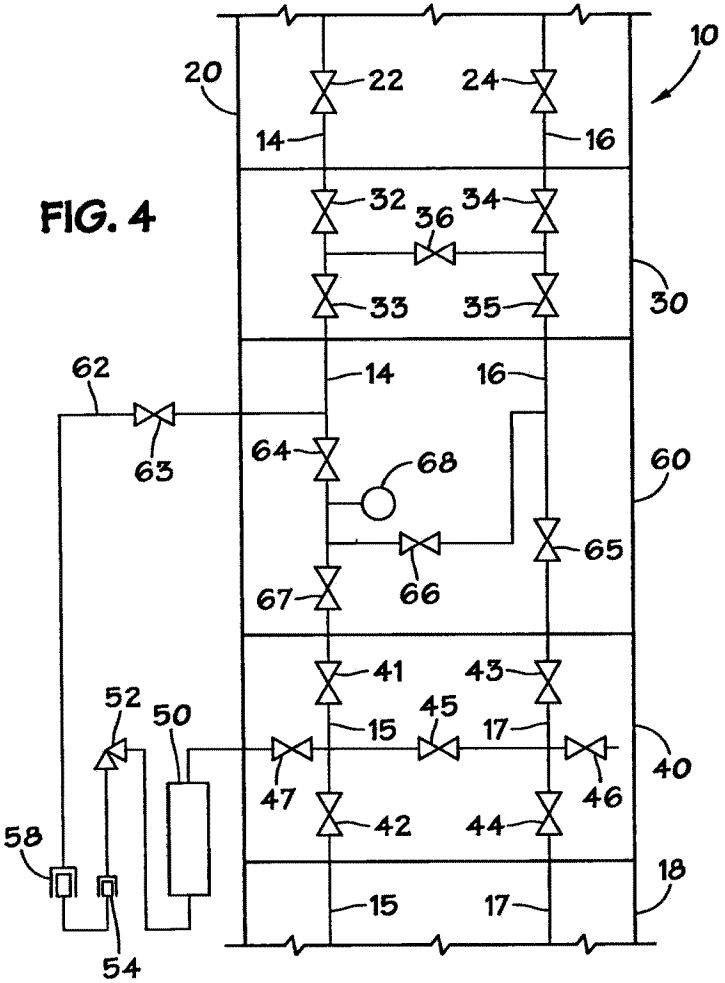
FIG. 4 is a schematic of an additional embodiment of an adapter disclosed herein disposed in a completion/work-over riser.
Figure 3:
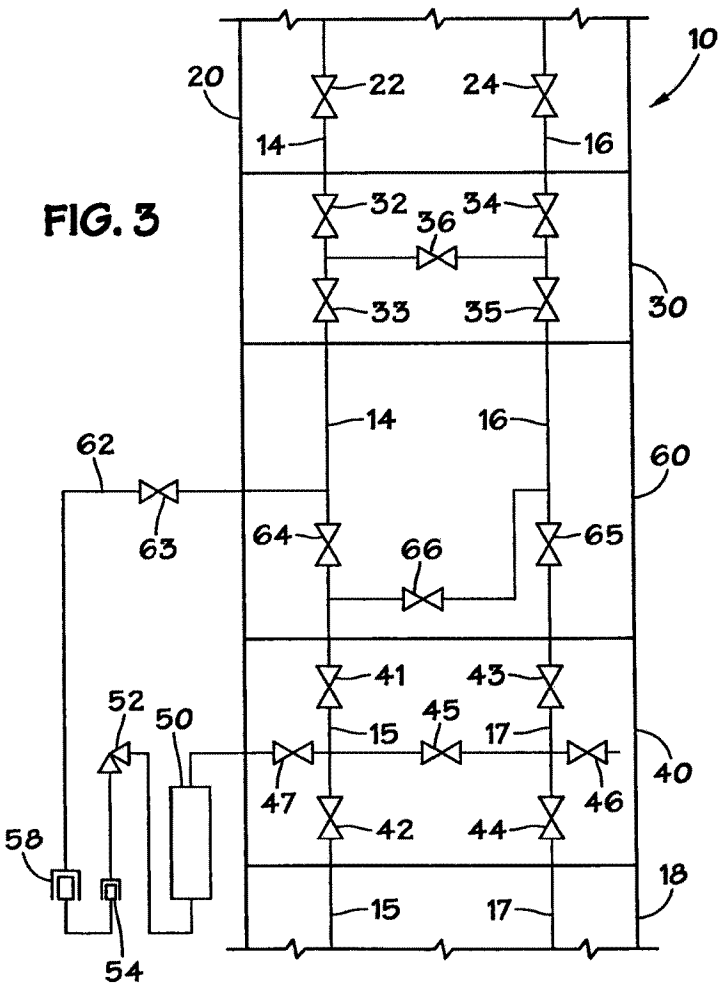
FIG. 3 is a schematic of still another specific embodiment of an adapter disclosed herein disposed in a completion/work-over riser.

In the embodiment of FIG. 1, adapter 60 includes an "open" fluid communication through flow loop 62 between production bore 14 and flow loop hub 58. In the embodiment of FIG. 2, flow loop 62 includes flow loop isolation valve 63 so that fluid flow through flow loop 62 can be selectively opened or closed. In the embodiment of FIG. 3, adapter 60 further includes first production bore isolation valve 64, annulus bore isolation valve 65, and cross-over valve 66 disposed below first production bore isolation valve 64 and above annulus bore isolation valve 65. In the embodiment of FIG. 4, adapter 60 further includes second production bore isolation valve 67 and pressure/temperature sensor 68 disposed between first and second production bore isolation valves 64, 67. Pressure/temperature sensor 68 is known in the art.

Adaptor 60 is secured to subsea Christmas tree 40 through a hydraulic connector that can be locked and unlocked through either an installation work-over control system (not shown) or by an ROV power pack (not shown) which is used to lock the adaptor to the top of subsea Christmas tree 40. Such connectors and their operation are known in the art. Similarly, adapter 60 is secured to lower riser package 30 through a mandrel lock-up arrangement through the use of a hydraulic connector disposed on the lower end of the lower riser package 30.

The valves of adapter 60 can be controlled by direct hydraulics from the installation work-over control system's umbilical or, in the case of deep water operations, by the installation work-over control system's subsea control module on emergency disconnect package 20. Flow loop 62 can have a hydraulic connector operated by either the installation work-over control system or ROV to connect flow loop 62 to production flow loop hub 58. Flow loop isolation valve 63 can be a hydraulically actuated valve or an ROV operated valve.

In operation of any of the embodiments shown in FIGS. 1-4, adapter 60 is used to circulate fluid through subsea multi-phase flow meter 50 during well clean-up and performance testing. In so doing, multi-phase flow meter 50 is tested not only for operational purposes, but also for calibration purposes because the fluid flowing through multi-phase flow meter 50 during clean-up is fluid flowing directly from subsea Christmas tree 40. Thus, calibration of multi-phase flow meter 50 can be performed prior to removal of riser 10 and, thus, before production operations begin. During this calibration and testing, a second multi-phase flow meter (not shown) can be disposed at the surface and in fluid communication with the surface Christmas tree (not shown) to provide more instantaneous feedback on flow rates and verification that the subsea multi-phase flow meter 50 is operating correctly.

In one operation of the embodiment of FIG. 1, production bore swab valve 41 is closed and production bore master valve 42 and production wing valve 47 are opened. As result, fluid flows from wellhead 18, through production bore master valve 42 and production wing valve 47 and, thus, through subsea multi-phase flow meter 50. The fluid then exits multi-phase flow meter 50 and flows through production control valve 52, through flowline connector/hub 54, and through production flow loop hub 58. The fluid then exits production flow loop hub 58 and flows through flow loop 62 into adapter 60 where the fluid then reenters production bore 14 and can flow up to the surface for clean-out and for equipment testing at the surface. During this operation, subsea multi-phase flow meter 50 is tested for operational integrity and is calibrated based upon actual production flow conditions.

With respect to FIG. 2, the clean-up and testing operations of FIG. 1 can be regulated by flow loop isolation valve 63. Alternatively, or in addition, first production bore isolation valve 64, annulus bore isolation valve 65, and/or cross-over valve 66, can be included in adapter 60 such as in the embodiment of FIG. 3 to reduce the likelihood of leakage along production bore 14 and annulus bore 16 thereby increasing the accuracy of the testing and calibrating occurring at multi-phase flow meter 50. In embodiments having annulus bore isolation valve 65 and cross-over valve 66, these valves also permit flushing of produced fluids from the multi-phase flow meter 50 and associated components, e.g., fluid lines and valves involved in the testing, after well testing and filling of bores 15, 17 with preservation fluids to maintain the components during removal of riser 10 and during the time period before production is initiated.

In one specific well test operation using the adaptor 60 shown in FIG. 3 or in FIG. 4, adapter 60 is secured to the lower end of riser 10 and riser 10 is lowered and secured to subsea Christmas tree 40. After being installed, all of the pressure barriers are tested with first production bore isolation valve 64 (FIG. 3) or first production bore isolation valve 64 and second production bore isolation valve 67 (FIG. 4) open, and, flow loop isolation valve 63 closed. The well is then opened by opening production bore master valve 42 on subsea Christmas tree 40. All other valves can either be in the opened position or the closed position as desired or necessary to clean-up the desired fluid lines and valves within one or more of emergency disconnect package 20, lower riser package 30, subsea Christmas tree 40, and adapter 60. For example, in one such operation, all of the other valves are in the closed position so that fluid flowing from wellhead 18 for purposes of clean-up flows directly up production bores 14, 15 to the surface.

After sufficient clean-up has occurred, first production bore isolation valve 64 (FIG. 3) or first production bore isolation valve 64 and second production bore isolation valve 67 (FIG. 4) is/are closed and flow loop isolation valve 63 is opened. As a result, produced fluids flow from wellhead 18, through production bore master valve 42, through production wing valve 47 (which is opened during this operation), through multi-phase flow meter 50, through flowline connector/hub 54, through production flow loop hub 58, through flow loop 62, through flow loop isolation valve 63, and into production bore 14 within adapter 60. In so doing, multi-phase flow meter 50 can be cleaned up and tested for operation integrity and calibration.

After testing and clean-up are completed, the well is shut in by closing the production bore valves in subsea Christmas tree 40. Thereafter, other valves, including the various cross-over valves, can be opened and closed as appropriate to further clean-out the lines attached to these valves, and the valves themselves. In performing these further clean-up operations, the flow path through multi-phase flow meter 50 and, thus, production flow loop hub 58 and flow loop 60, can be clean out of production fluids and other corrosive fluids. Preservation or inhibitor fluids also can be flowed through and disposed within any of the fluid lines and valves of subsea Christmas tree 40, multi-phase flow meter 50, production control valve 52, flowline connector/hub 54, and production flow loop hub 58 to shut-in the well during removal of riser 10 and during the time period before production is initiated.

After clean-up and, if desired, preservation operations are completed, and the well is shut-in by closing the appropriate valves within subsea Christmas tree 40, all pressure barriers can be set and adaptor 60 can be disconnected from subsea Christmas tree 40 and removed with the rest of riser 10 for use on another well.

Figure 5:
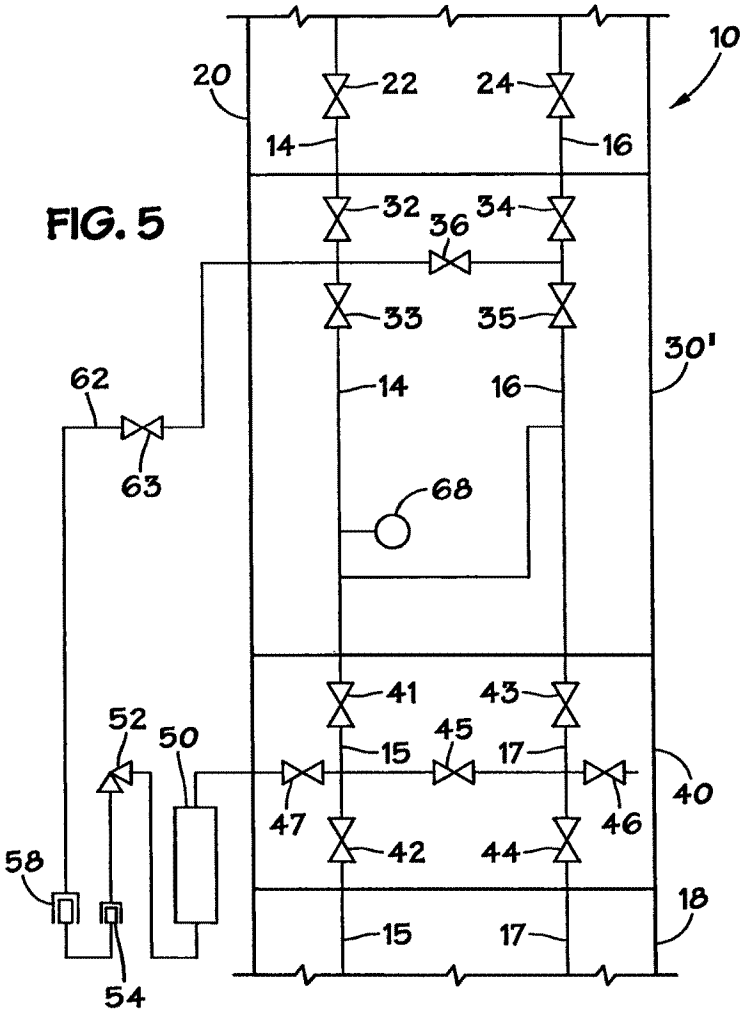
FIG. 5 is a schematic of an embodiment of a completion/work-over riser having a fluid flow loop in fluid communication with the production bore of the riser.

The foregoing described adapter, or adaptor, 60 has been described for use with presently existing equipment, including a riser 10 having an emergency disconnect package 20 and lower riser package 30, for use with a subsea Christmas tree 40 and wellhead 18. If desired, the foregoing described features and components of adapter 60 could be included in a new lower riser package at the time the lower riser package is initially manufactured. For example, as shown in FIG. 5, a lower riser package 30' may be provided which has fluid flow loop, or flow loop, 62 in fluid communication with production bore 14. Lower riser package 30' may include the features and components of adapter 60 as shown and previously described in connection with the risers 10 of FIGS. 1-4. Some of the features and components of riser 10 of FIG. 4 are illustrated in connection with FIG. 5, such as pressure/temperature sensor 68; however lower riser package 30' may just include the features and components of risers 10 of FIGS. 1-4, or any desired combination of features and components of FIGS. 1-4. The operation of the features and components of the previously described adapter 60 would operate in the same manner in connection with lower riser package 30' of FIG. 5.

Figure 6:
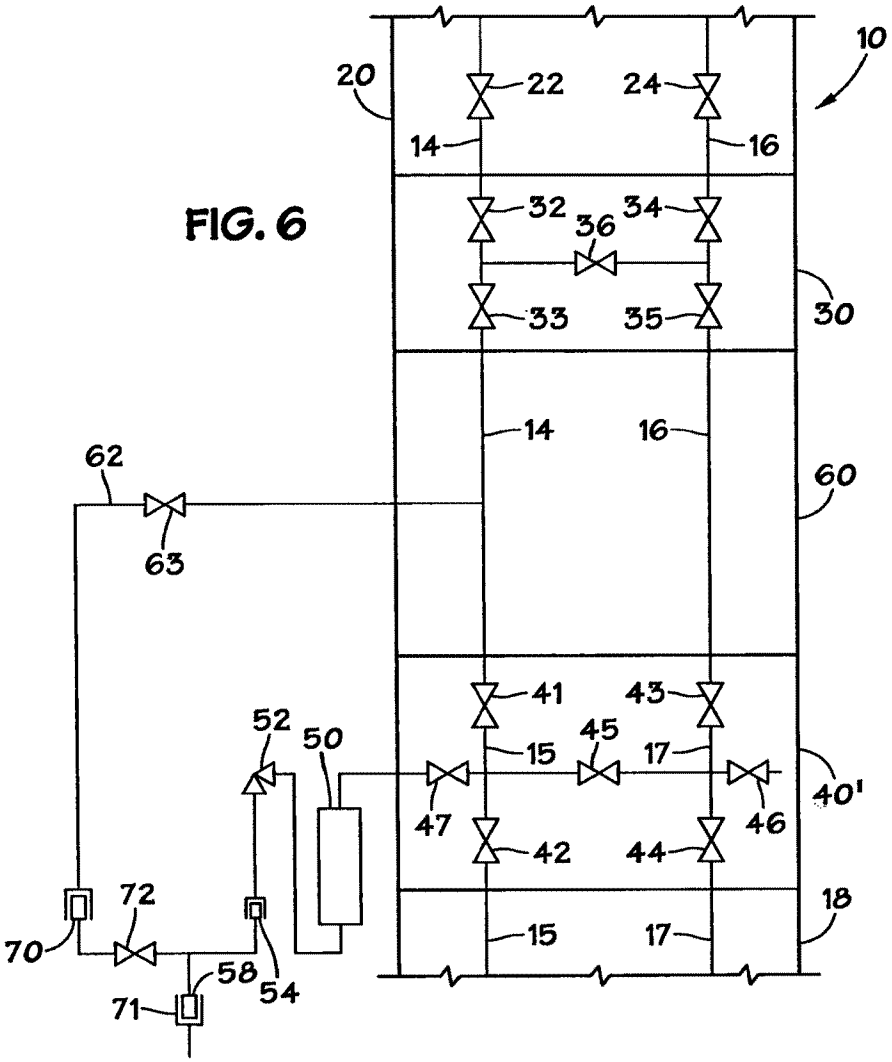
FIG. 6 is a schematic of an additional embodiment of an adapter disclosed herein disposed in a completion/work-over riser.

With reference to FIG. 6, fluid flow loop 62 of adapter 60 is in fluid communication with Christmas tree 40', and Christmas tree 40' includes an additional hub, or test hub, 70 and an isolation valve, or remote operated isolation valve, 72 in fluid communication with flowline connector/hub 54 and production flow loop hub 58 of Christmas tree 40'. As shown in FIG. 6, the production flow loop hub 58 may be provided with an isolation cap 71. If testing of the multi-phase flow meter 50 is desired, or required, after the installation of Christmas tree 40' and its attendant well clean-up, the multi-phase flow meter 50 may be tested by flowing fluid from the production bore 15 through: multi-phase flow meter 50; flow line connector/hub 54; isolation valve 72; test hub 70; flow loop 62; and, if utilized, through flow loop isolation valve 63, in order to test the multi-phase flow meter 50. Isolation cap 71 would prevent fluid from exiting production flow loop hub 58. If desired, test hub 70 could initially be provided with a pressure cap, or isolation cap (not shown) when test hub 70 is initially utilized, which may be subsequently removed.

Figure 7:
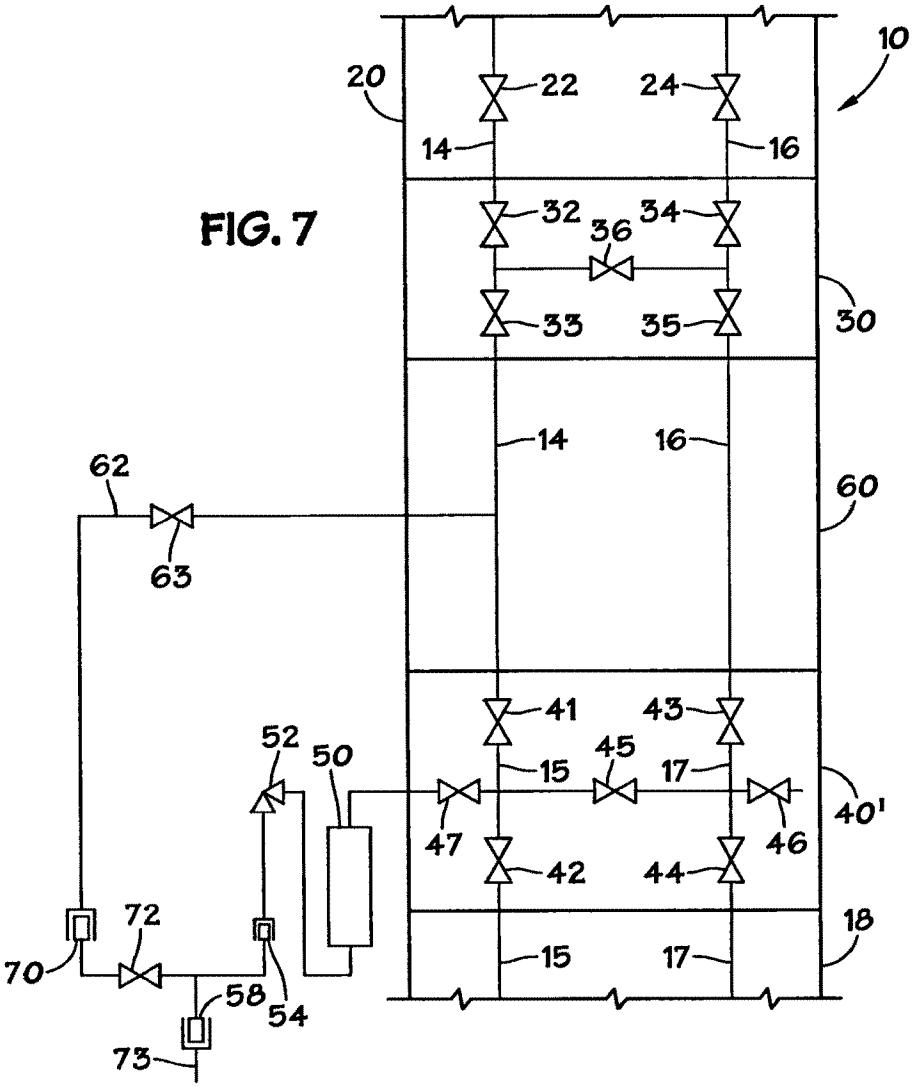
FIG. 7 is a schematic of the adapter of FIG. 6, illustrating how a flow meter may be tested while a wellhead is connected to a flow line.

With reference to FIG. 7, a fluid line, or fluid flow line, 73 is shown in fluid communication with production flow loop hub 58 with fluid flowing through production flow loop hub 58 into flow line, or fluid line, or flow line jumper, 73 in fluid communication with a production platform, production vessel, pipeline or the like (not shown). Isolation valve 72 would be opened so multi-phase flow meter 50 may be tested with the well connected to flowline 73.

The components and features of adapter 60 and Christmas tree 40' are illustrated in connection with the embodiments of riser 10 of FIG. 2 previously described. If desired the components and features of Christmas tree 40', in particular the test hub 70 and isolation valve 72, could also be utilized with the risers 10 of FIGS. 1 and 3-4 previously described, as well as these features could be utilized with lower riser package 30' as previously illustrated and described in connection with FIG. 5.

It is to be understood that the invention is not limited to the exact details of construction, operation, exact materials, or embodiments shown and described, as modifications and equivalents will be apparent to one skilled in the art. For example, not every valve shown in FIGS. 1-4 is required. Moreover, flow loop 62 can be formed out of a rigid material or a flexible material. In addition, the order of opening and closing the various valves during clean-up, testing or calibration of multi-phase flow meter 50 can be modified as desired or necessary to perform these and any other operations, e.g., preservation operations. Accordingly, the invention is therefore to be limited only by the scope of the appended claims.

What is claimed is:

1. An adapter for securing on a vertical subsea Christmas tree, having a production wing valve, the adapter comprising:

a production bore;

an annulus bore;

a fluid flow loop in fluid communication with the production bore, the fluid flow loop being releasably connected to a production flow loop hub of a vertical subsea Christmas tree, wherein the production flow loop hub is in fluid communication with a multi-phase flow meter, the multi-phase flow meter being in fluid communication with the production wing valve of the vertical subsea Christmas tree, to verify operation, and calibration, of the multi-phase flowmeter with a fluid from the production wing valve.

2. The adapter of claim 1, wherein the fluid flow loop includes a flow loop isolation valve.

3. The adapter of claim 2, including a first production bore isolation valve, an annulus bore isolation valve, and a cross-over valve.

4. The adapter of claim 3, wherein the cross-over valve is disposed below the first production bore isolation valve and above the annulus bore isolation valve.

5. The adapter of claim 4, including a second production bore isolation valve and a pressure/temperature sensor.

6. The adapter of 5, wherein the pressure/temperature sensor is disposed between the first production bore isolation valve and the second production bore isolation valve.

7. A riser assembly comprising:

an emergency disconnect package, the emergency disconnect package comprising an emergency disconnect package production bore and an emergency disconnect package annulus bore;

a lower riser package, the lower riser package comprising a lower riser package production bore and a lower riser package annulus bore, the lower riser package production bore being in fluid communication with the emergency disconnect package production bore and the lower riser package annulus bore being in fluid communication with the emergency disconnect package annulus bore;

an adapter for securing on a vertical subsea Christmas tree having a production wing valve, the adapter comprising a flow loop and an adapter production bore and an adapter annulus bore, the adapter production bore being in fluid communication with the lower riser package production bore and the adapter annulus bore being in fluid communication with the lower riser package annulus bore, wherein, the flow loop is in fluid communication with the adapter production bore and releasably connectable to a production line and the production wing valve of the vertical subsea Christmas tree, with a multi-phase flow meter in fluid communication with the production wing valve and the flow loop, to verify operation and calibration of the multi-phase flow meter with a fluid from the production wing valve.

8. The riser assembly of claim 7, wherein the emergency disconnect package includes a production bore isolation valve and an annulus bore isolation valve.

9. The riser assembly of claim 7, wherein the lower riser assembly package includes a first and a second production bore isolation valve, a first and a second annulus bore isolation valve, and a cross-over valve disposed between the first and second production bore isolation valves and between the first and second annulus bore isolation valves.

10. The riser assembly of claim 9, wherein the first and second production bore isolation valves of the lower riser assembly and the first and second annulus bore isolation valves of the lower riser assembly are rams.

11. A method of testing flow from a vertical subsea Christmas tree having a production wing valve, the method comprising the steps of:

(a) installing an adapter on the vertical subsea Christmas tree, the adapter having a flow loop in fluid communication with a production bore of the vertical subsea Christmas tree and in fluid communication with a multi-phase flow meter operatively associated with the production wing valve of the vertical subsea Christmas tree;

(b) flowing production fluid from a wellhead operatively associated with the vertical subsea Christmas tree, through the production bore of the vertical subsea Christmas tree, through the production wing valve, through the multi-phase flow meter, through the flow loop of the adapter, and into a production bore of the adapter; and (c) during step (b), testing the functionality of the multi-phase flow meter.

* * * * *